US008078347B2

(12) United States Patent
Minoura

(10) Patent No.: US 8,078,347 B2
(45) Date of Patent: Dec. 13, 2011

(54) CONTROL DEVICE FOR WATERCRAFT PROPULSION SYSTEM

(75) Inventor: Minoru Minoura, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 1034 days.

(21) Appl. No.: 11/954,575

(22) Filed: Dec. 12, 2007

(65) Prior Publication Data

US 2008/0154453 A1 Jun. 26, 2008

(30) Foreign Application Priority Data

Dec. 26, 2006 (JP) ..... 2006-350399

(51) Int. Cl.
*B60L 3/00* (2006.01)

(52) U.S. Cl. ..... 701/21; 440/1; 440/86; 440/87

(58) Field of Classification Search ..... 701/21; 440/84–87

See application file for complete search history.

(56) References Cited

U.S. PATENT DOCUMENTS 7,238,071 B2 7/2007 Takada et al.
2006/0009096 A1* 1/2006 Takada et al. ..... 440/84

* cited by examiner

*Primary Examiner* — Thomas Black
*Assistant Examiner* — Luke Huynh
(74) *Attorney, Agent, or Firm* — Keating & Bennett, LLP

(57) ABSTRACT

A control device for a watercraft propulsion system can reduce wear of a shift mechanism, can achieve an automated extremely slow speed navigation and easy watercraft navigation, and can negate differences between watercraft navigation skills of watercraft operators. A remote control operation section includes a remote controller shift lever. A watercraft propulsion section includes a shift change unit and a shift actuator arranged to drive the shift change unit, a main control section arranged to control an operation of the shift actuator based upon an operational amount of the remote controller shift lever, an auxiliary control section arranged to control a watercraft to move at an extremely slow speed, and a changeover section arranged to select one of the main control section and an auxiliary control section. The auxiliary control section includes a data table for moving a watercraft hull at an extremely slow speed, and the auxiliary control section outputs an execution instruction of extremely slow speed navigation to the shift actuator by selecting one of extremely slow speed navigation instructing data from the data table.

5 Claims, 8 Drawing Sheets

FIG. 6A $49_1$ (FOR FORWARD MODE)

| | LEVER ANGLE | NEUTRAL | FORWARD |
|---|---|---|---|
| $49a_1$ | 0 | 30 | 1 |
| $49a_2$ | 10 | 25 | 1 |
| ⋮ | 20 | 15 | 1 |
| $49a_4$ | 30 | 12 | 2 |
| ⋮ | 40 | 10 | 3 |
| ⋮ | 50 | 8 | 4 |
| $49a_7$ | 60 | 6 | 5 |
| ⋮ | 70 | 0 | 30 |
| $49a_9$ | 75 | 0 | 30 |

FIG. 6B $49_2$ (FOR REVERSE MODE)

| | LEVER ANGLE | NEUTRAL | REVERSE |
|---|---|---|---|
| $49b_1$ | 0 | 25 | 1 |
| $49b_2$ | 10 | 15 | 1 |
| ⋮ | 20 | 10 | 2 |
| $49b_4$ | 30 | 6 | 5 |
| ⋮ | 40 | 3 | 10 |
| $49b_6$ | 45 | 0 | 30 |

CONTROL DEVICE FOR WATERCRAFT PROPULSION SYSTEM

BACKGROUND OF THE INVENTION

1. Field of the Invention

The present invention relates to a control device for a watercraft propulsion system that can control a watercraft to move automatically at an extremely slow speed when it is necessary.

2. Description of the Related Art

In a so-called trolling manner, in which a watercraft is not anchored, it is a very important challenge for a watercraft operator to operate the watercraft so as not to drift but to position an end of a fishing line at a "point" where fish flock (hereunder, called merely "point"). The operator making use of the trolling manner performs a particular navigation to continuously locate the end of the fishing line at the "point". The navigation is performed to slightly move the watercraft forward or backward while alternating a state in which a forward gear or a reverse gear is in an engaging position and a state in which both of the forward and reverse gears are disengaging positions in a short period and repeating the alternations. In this description, the navigation will be referred to as "extremely slow speed navigation." Conventionally, the extremely slow speed navigation is made by a watercraft operator who repeatedly changes a remote controller shift lever, which is located at a cockpit, between a forward position (or a reverse position) and a neutral position at short intervals generally existing in a range of several seconds through tens of seconds.

However, in the conventional extremely slow speed navigation state, the watercraft operator needs to perform change operations of the remote controller shift lever while foreseeing and determining the fact that the watercraft does not stop due to inertia and other circumstances by making use of his or her experiences and imaginations (intuitions). Therefore, every watercraft operator may have his or her own frequencies for the change operations of the remote controller shift lever per unit time. Particularly, watercraft operators who have less experience are likely to have a number of frequencies for the change operations of the remote controller shift lever. Accordingly, there have been indications that a life of a shift mechanism for a watercraft propulsion system (engine) can be extremely short and other drawbacks can happen because clutch change times increase and a clutch is burdened.

On the other hand, in the trolling manner, it is of course quite desirable that the watercraft stays at the point for a longer period of time, regardless of broadness or narrowness of the "point", to locate the maximum number of fish. If, however, the "point" has a broad area, the watercraft operator needs to fish while moving the watercraft over a long distance. The watercraft operator thus is required to move the watercraft back to a point or the like where the watercraft started to drift as soon as possible in order to perform effective fishing with ample time that can be almost entirely dedicated to the fishing.

On the other hand, if the so-called hands-free watercraft navigation (automatic watercraft navigation) is practicable for a longer period of time, the operation is convenient for the watercraft operator because the watercraft operator may spend much time for confirming the safety of passengers and the watercraft, and performing other operations. However, the watercraft operator needs to perform change operations of the shift lever in the conventional speed navigation state. Accordingly, there arises a problem that the hands-free operation is difficult in the extremely slow speed navigation state more than in a navigation state in which the watercraft is moved forward or backward while the forward gear or the reverse gear is engaged (in the description, this navigation is referred to as "normal navigation").

In the meantime, the following outboard motor is known as the watercraft propulsion system. As disclosed in JP-A-2006-021557, the outboard motor has a structure which performs a single shift control whereby an electric motor for a shift operation is controlled so that a shift position is periodically changed between a forward or reverse (gear-in) position and a neutral position. Skill for the watercraft navigation thus can vary more or less according to each watercraft operator. That is, differences inevitably exist between watercraft navigation skills of individual watercraft operators. In other words, the outboard motor noted above has a limit in the minute shift control (watercraft navigation) that is adapted to the trolling operation. Therefore, the outboard motor is far from sufficient for resolving the problems described above and still gives rise to problems such that the watercraft operator cannot easily make much time for other operations.

SUMMARY OF THE INVENTION

In order to overcome the problems described above, preferred embodiments of the present invention provide a novel control device for a watercraft propulsion system that can reduce wear on a shift mechanism, can achieve an automated extremely slow speed navigation and easy watercraft navigation and can resolve differences between watercraft navigation skills of individual watercraft operators.

A control device for a watercraft propulsion system according to a preferred embodiment of the present invention includes a remote controller operating section including a remote controller shift lever for remotely controlling forward, neutral and reverse modes, a watercraft propulsion section including a shift change unit arranged to make shift changes among the forward, neutral and reverse modes and a shift actuator arranged to drive the shift change unit, and a main control section arranged to control an operation of the shift actuator based upon an operational amount of the remote controller shift lever when the remote controller shift lever is operated. The control device further includes an auxiliary control section arranged to control a watercraft to move at an extremely slow speed by alternately changing the shift actuator between the forward or reverse shift mode and the neutral mode, and a change operation section arranged to select one of the auxiliary control section and the main control section. The auxiliary control section includes a selection table including a plurality of extremely slow speed navigation instructing data which are made by combining a predetermined forward or reverse period and a predetermined neutral period, the selection table being provided for moving a watercraft hull at the extremely slow speed when the change operation section is changed to an extremely slow speed control state. The remote controller operating section includes an instructing data selecting section arranged to output an execution instruction of the extremely slow speed navigation to the shift actuator by selecting one of the plurality of extremely slow speed navigation instructing data.

The remote control lever preferably functions as the instructing data selecting section when the auxiliary control section is selected by the change operation section. The one of the plurality of extremely slow speed navigation instructing data is selected based upon the operational amount of the shift lever.

An extremely slow speed control position functioning as the change operation selection preferably is placed in an operation range of the remote controller shift lever, and the instructing data selecting section is capable of selecting the one of the plurality of extremely slow speed navigation instructing data.

The extremely slow speed control position is preferably placed at least in a range between a neutral position and a forward position or in a range between the neutral position and a reverse position.

As a speed that is slower in the extremely slow speed navigation instructing data, the forward or reverse period is preferably set to be shorter and the neutral period is preferably set to be longer. As the speed that is faster in the extremely slow speed navigation instructing data, the forward or reverse period is preferably set to be longer and the neutral period is preferably set to be shorter.

An individual one of the extremely slow speed navigation instructing data included in the selection table is preferably set to be adapted to a characteristic of an engine of an individual one of the watercraft propulsion devices, a characteristic of the individual particular watercraft and so forth.

In a preferred embodiment of the present invention, the change operation section changes the main control section that performs the normal navigation to the auxiliary control section that performs the extremely slow speed navigation. Afterwards, one of various sorts of extremely slow speed navigations which are previously set can be easily and automatically performed by operating the instructing data selecting section. Then, the auxiliary control section automatically performs shift change operations between the forward or reverse shift mode and the neutral shift mode in the extremely slow speed navigation state. Thereby, the watercraft operator can be relieved from having to perform complicated shift change operations in the extremely slow speed navigation state. Because the automatic navigation can provide the watercraft operator with much useful time, the watercraft operator can confirm the safety of passengers and of the watercraft and also other operations, all of which are more important than the shift change operations. In addition, timing of the shift changes between the forward or reverse shift mode and the neutral shift mode in the extremely slow speed navigation state can be automatically determined in accordance with the forward or reverse period and the neutral period which are previously set in the extremely slow speed navigation instructing data. Therefore, the variations in the operation skill appearing with regard to the outboard motor disclosed in JP-A-2006-21497 can be negated. The differences in the watercraft navigation skills of individual watercraft operators and the indicated problems arising due to the differences can be resolved, accordingly.

The forward or reverse period and the neutral period preset in the extremely slow speed navigation instructing data can be set as long as possible individually. The shift operation times (clutch change times) in the extremely slow speed navigation state thus can be reduced. Hence, the situation in which the life of an engine is shortened due to wear on the shift device, which may be caused by a watercraft operator who has less experience, can be avoided.

The selection table preferably includes the plurality of extremely slow speed navigation instructing data. The shift actuator can be operated in accordance with one of the extremely slow speed navigation instructing data selected following the operation by the watercraft operator to move the watercraft in the extremely slow speed navigation state. Therefore, one of the extremely slow speed navigation instructing data adapted to tide velocity and wind velocity can be selected so that the watercraft can stay at the "point" as long as possible (i.e., the actual time for fishing can be increased and expanded). The control thus is much more conducive to maximizing fishing time. That is, by making good use of the various sorts of the extremely slow speed navigation instructing data belonging to the selection table, the minute navigation of the watercraft can be made.

After selecting the auxiliary control section by the change operation section, one of the extremely slow speed navigation instructing data is optionally selected using the remote controller shift lever. Because the remote controller shift lever is constructed to achieve, without any other elements, both the shift change function in the normal navigation state and the function for selecting one of the extremely slow speed navigation instructing data adapted to the "point" in the extremely slow speed navigation state, the construction of the remote control lever can be simple and the lever has good operability.

The normal navigation and the extremely slow speed navigation can be changed to one another only by an inclination angle of the one remote controller shift lever. In addition, the remote controller shift lever can achieve both the shift change function in the normal navigation state and the function for selecting one of the extremely slow speed navigation instructing data in the extremely slow speed navigation state. The construction of the remote controller shift lever thus can be simple and the lever has good operability.

A position of the remote controller shift lever at which the extremely slow speed navigation is remotely controlled can be placed at a location ranging to the forward position or the reverse position. Hence, the selection of the forward mode in the extremely slow speed navigation state and the selection of the reverse mode in the extremely slow speed navigation state both by the remote controller shift lever can be made easily and rapidly by continuous operations from the forward mode in the normal navigation state and from the reverse mode in the normal navigation state.

As a speed that is slower in the extremely slow speed navigation instructing data, the forward or reverse period is preferably set to be shorter and the neutral period is preferably set to be longer, and as the speed that is faster in the extremely slow speed navigation instructing data, the forward or reverse period is preferably set to be longer and the neutral period is preferably set to be shorter. Therefore, the speed can be adjusted while the shift change times are reduced as small as possible. The watercraft thus can be easily kept at the "point." The watercraft operator can easily respond to situations and circumstances. The inconvenience derived from the differences between the operation skills of the watercraft operators can be efficiently eliminated.

The extremely slow speed navigation instructing data preferably can be set based upon the size of a watercraft, performance of an engine and so forth. Thus, extremely slow speed navigation adapted to any condition of the watercraft can be made. The user can make the watercraft perform any extremely slow speed navigation which is convenient for the user.

Other features, elements, processes, steps, characteristics and advantages of the present invention will become more apparent from the following detailed description of preferred embodiments of the present invention with reference to the attached drawings.

BRIEF DESCRIPTION OF THE DRAWINGS

FIGS. 6A and 6B illustrate selection tables, with FIG. 6A illustrating a selection table for a forward mode and FIG. 6B illustrating a selection table for a reverse mode.

DETAILED DESCRIPTION OF PREFERRED EMBODIMENTS

With reference to FIGS. 1 through 5, a first preferred embodiment of the present invention will be described.

Figure 1:
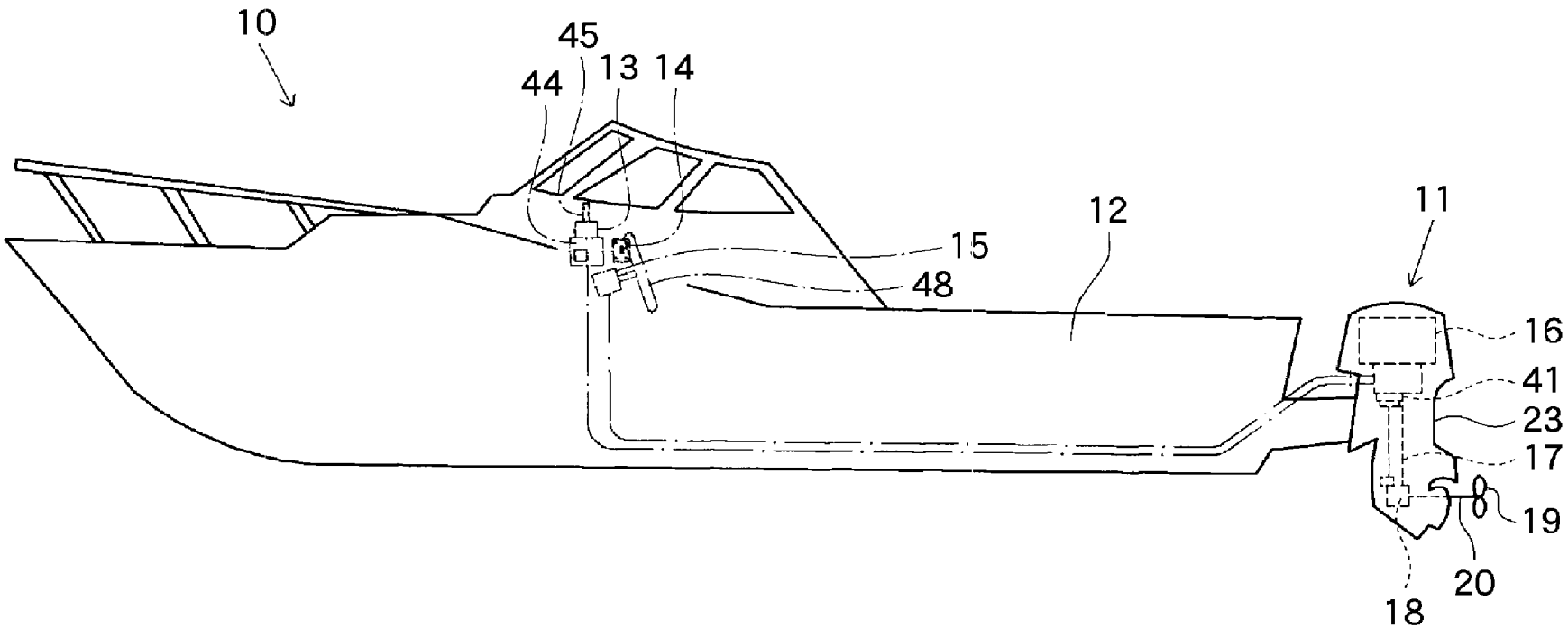
FIG. 1 is a side elevational view showing a watercraft which has a control device for a watercraft propulsion system configured in accordance with a preferred embodiment of the present invention.

As shown in FIG. 1, a watercraft 10 is equipped with an output board motor 11 according to the first preferred embodiment of the present invention. That is, the outboard motor 11 functioning as the "watercraft propulsion system" is mounted to a transom of a hull 12 of the watercraft 10. The outboard motor 11 is controlled by a remote controller operating unit 13, a key-switch unit 14, a steering unit 15, etc.

Figure 2:
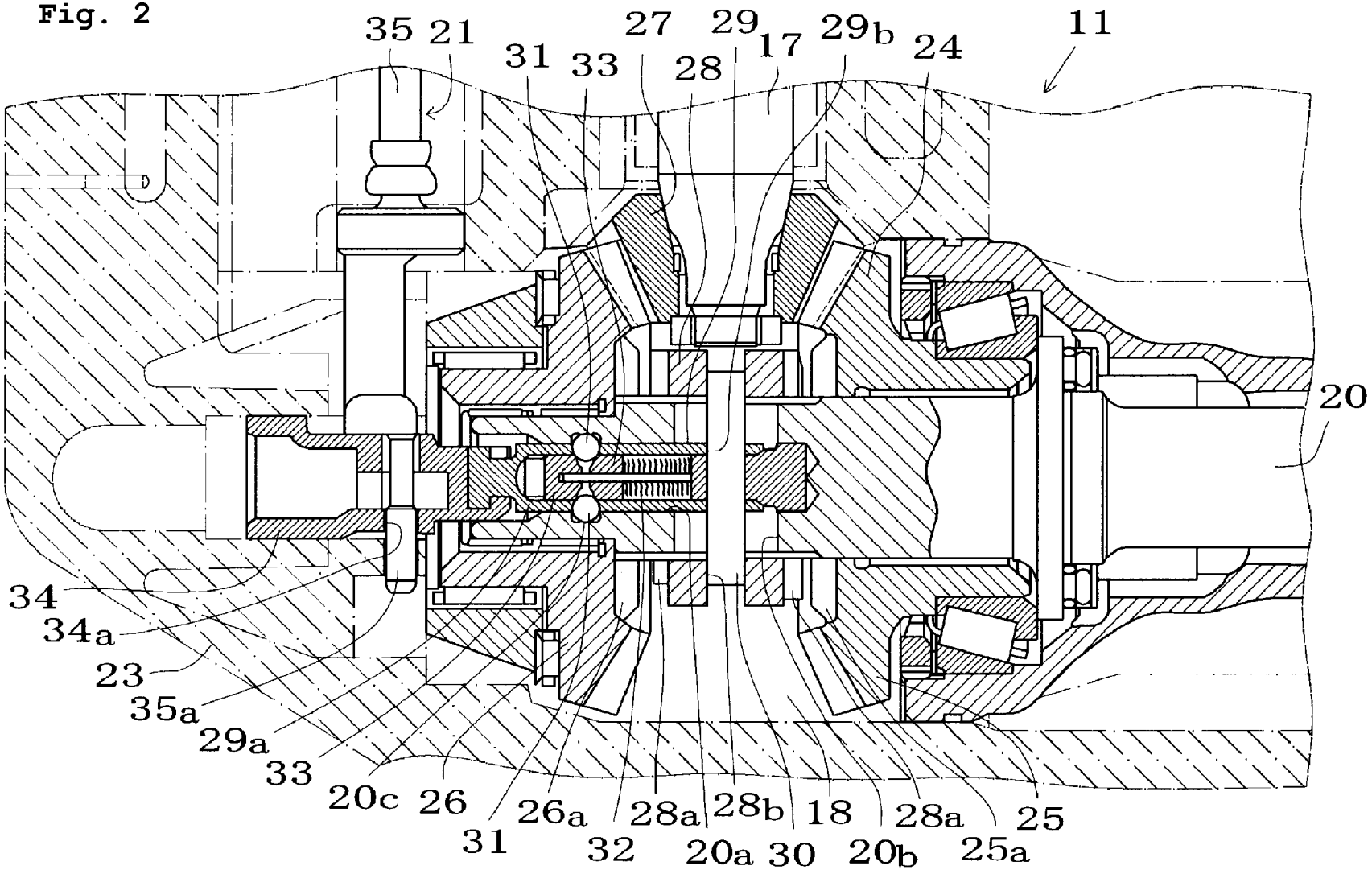
FIG. 2 is a cross sectional view showing the major portion of the shift device for the watercraft propulsion system of a preferred embodiment of the present invention.
Figure 3:
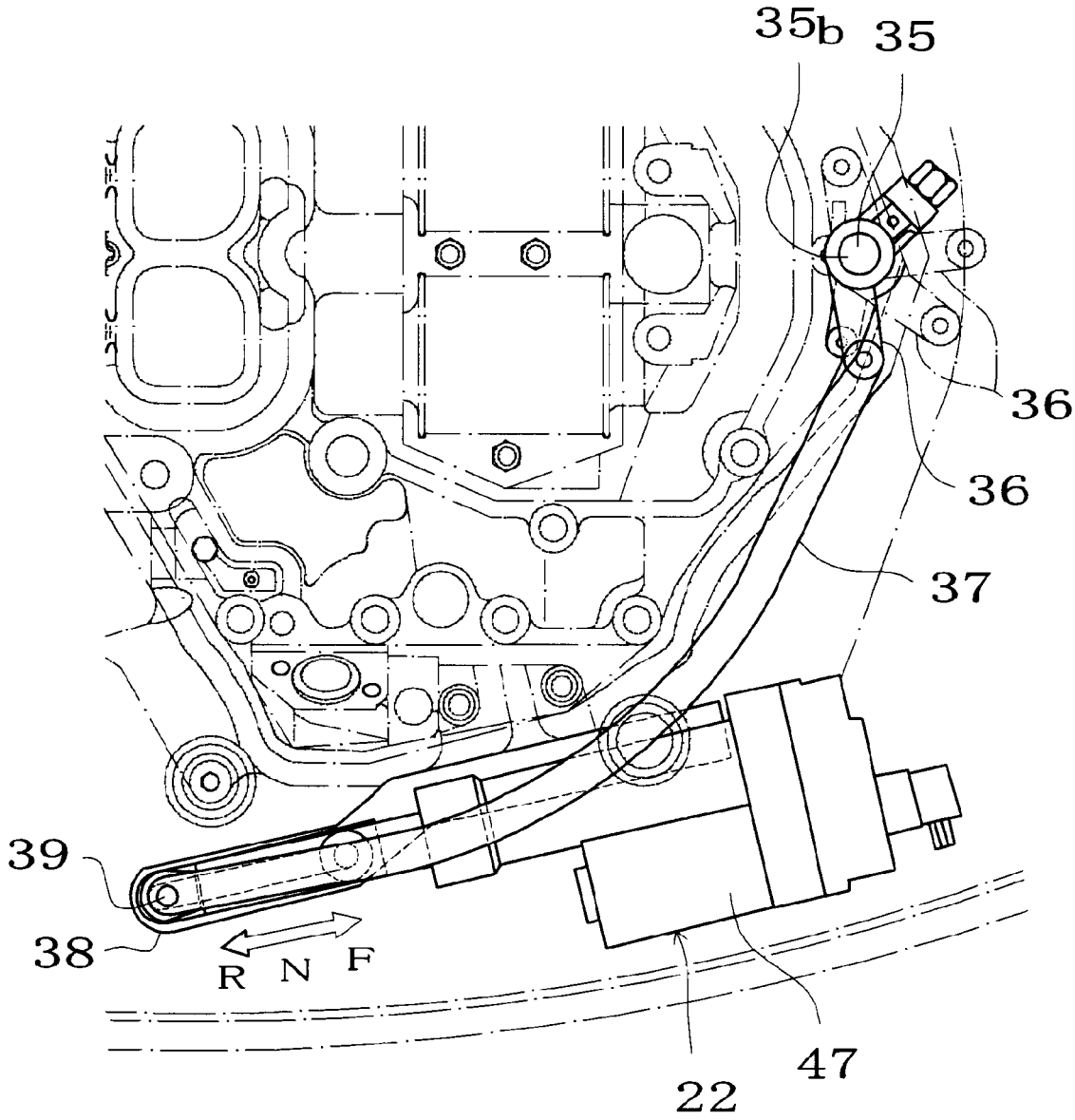
FIG. 3 is a top plan view showing the major portion including a shift actuator for the watercraft propulsion system of a preferred embodiment of the present invention.

As shown in FIGS. 1 through 3, the outboard motor 11 has an engine 16 disposed in an upper portion thereof. The outboard motor 11 has a structure whereby an output of the engine 16 rotates a propeller 19 through a driveshaft 17, a shift device 18 and a propeller shaft 20.

A shift change unit 21 changes modes of the shift device 18 among forward, neutral and reverse modes. A shift actuator 22 actuates the shift change unit 21.

More specifically, as shown in FIGS. 2 and 3, the outboard motor 11 has a casing 23. The propeller shaft 20 extends generally horizontally within the casing 23. The propeller 19 is attached to the propeller shaft 20. The propeller shaft 20 is coupled with the driveshaft 17 through a shift gear mechanism 24 performing a forward/reverse propulsion changing function. The gear shift mechanism 24 includes a forward gear 25 and a reverse gear 26 both mounted to the propeller shaft 20 for rotation. The gears 25, 26 engage with a pinion 27 fixed to the driveshaft 17 that rotates clockwise in a top plan view, and the gears 25, 26 rotate in reverse directions with each other.

In this preferred embodiment, the forward gear 25 is located at a rear position relative to a forwarding direction (left direction of FIG. 2) of the watercraft, while the reverse gear 26 is located at a front position relative to the forwarding direction.

A sleeve-like dog clutch member 28 is coupled with an outer surface of the propeller shaft 20 in spline connection between the forward gear 25 and the reverse gear 26. The dog clutch member 28 is slidable in an axial direction of the propeller shaft 20. The dog clutch member 28 has pawls 28*a* projecting from both sides thereof in the axial direction. The respective forward and reverse gears 25, 26 have pawls 25*a*, 26*a* extending toward the pawls 28*a*. The pawls 25*a*, 26*a*, and the pawls 28*b* can engage or disengage with each other to form a clutch.

A front end portion of the propeller shaft 20 has an aperture 20*a* whose front end in the axial direction opens forward. A shift sleeve 29 is inserted into the aperture 20*a* for sliding+ movement therein in the axial direction. A portion of the propeller shaft 20 corresponding to the aperture 20*a* has an elongate aperture 20*b* elongated in the axial direction.

Through-holes 28*b*, 29*b* extend through the dog clutch member 28 and the shift sleeve 29, respectively, in a radial direction. A pin 30 is inserted into the through-hole 28*b* of the dog clutch member 28, the elongate aperture 20*b* of the propeller shaft 20 and the through-hole 29*b* of the shift sleeve 29.

With movement of the shift sleeve 29, the pin 30 moves axially within the elongate aperture 20*b*. The dog clutch member 28 thus is moved in the axial direction of the propeller shaft 20 via the pin 30.

Detent balls 31 engaging or disengaging with recesses 20*c* of the propeller shaft 20 are disposed around the shift sleeve 29 so that the detent balls 31 can enter the shift sleeve 29 or come out from the shift sleeve 29. The detent balls 31 are biased outward by a spring 32 and pressing members 33.

As shown in FIG. 2, a slidable shifter 34 is coupled with a front end 29*a* of the shift sleeve 29. The shifter 34 has an engaging groove 34*a* extending vertically.

A drive pin 35*a* is formed in a bottom end portion of a shift shaft 35 of the shift change unit 21 and at a crank-shaped part which is eccentric relative to a pivot center of the shift shaft 35*a*. The drive pin 35*a* is inserted into an engaging groove 34*a* of the shifter 34. The drive pin 35*a* eccentrically pivots with pivotal movement of the shift shaft 35. Thereby, the shifter 34 slides to slidably move the dog clutch member 28.

The dog clutch member 28 is slidably moved in one direction because of the pivotal movement of the shift shaft 35 in one direction. Also, the dog clutch member 28 is slidably moved in the other direction because of the pivotal movement of the shift shaft 35 in the other direction.

The shift shaft 35 extends upward. As shown in FIG. 3 which is a top plan view, a lever 36 is fixed to a top end 35*b* of the shift shaft 35. One end of a lever shift rod 37 is connected to a tip end of the lever 36 for pivotal movement. The other end of the lever shift rod 37 is connected to a slider 39 for pivotal movement. The slider 39 is disposed on a shift rail 38 for slide movement. The slider 39 is slidably moved in a preset direction by the shift actuator 22. Thereby, the shift shaft 35 is pivoted in a preset direction via the lever shift rod 37 and the lever 36.

The shift actuator 22 has a shift motor 47 which preferably is a DC motor functioning as a drive source, a speed reduction mechanism, etc. The shift actuator 22 is structured to drive the slider in the preset direction.

Figure 4:
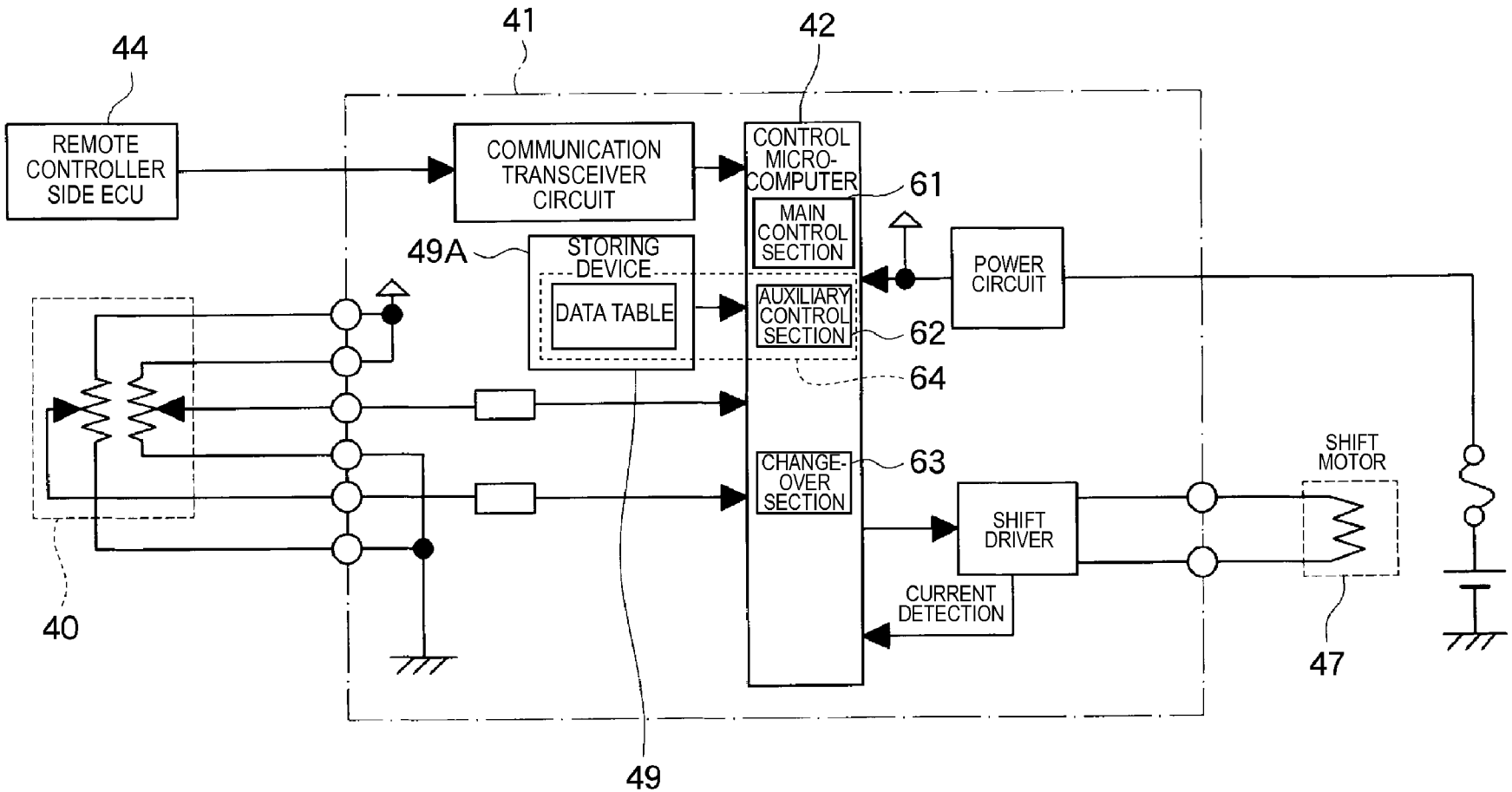
FIG. 4 is a block diagram showing a remote controller side ECU, an engine side ECU, etc. of the control device for the watercraft propulsion system of a preferred embodiment of the present invention.

As shown in FIG. 4, the shift actuator 22 has a shift position sensor 40. The sensor 40 detects shift positions (the forward position, neutral position and reverse position) and a shift speed. The detected information (signals) is inputted into a control micro-computer 42 of an engine side ECU 41.

The remote controller operating section 13 includes an electronic control unit (remote controller side ECU 44) functioning as a remote controller side control section and incorporated in a remote controller body 43 and a remote controller shift lever 45 performing throttle/shift operations. The forward, neutral and reverse modes are remotely controlled by operating the remote controller shift lever 45.

Figure 5:
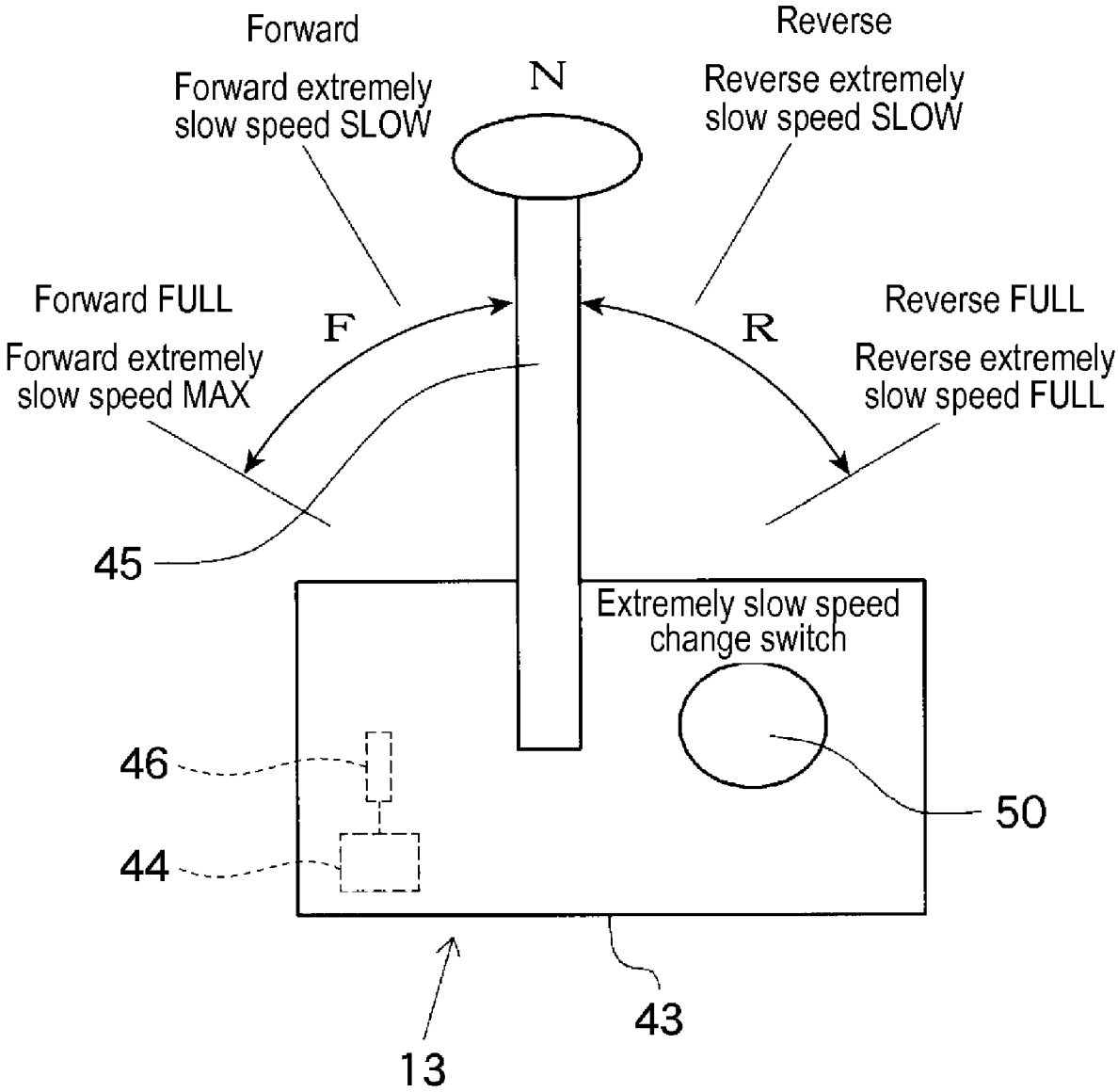
FIG. 5 is a side elevational view of a remote controller operating device of a preferred embodiment of the present invention.

As shown in FIG. 5, the remote controller shift lever 45 has a generally vertically extending center position, a forward inclining position (left side of FIG. 5) and a rearward inclining position (right side of FIG. 5). The center position defines the neutral position (N). The forward inclining position inclines forward with a certain angle from the center position and defines the forward position (F). The rearward inclining position inclines rearward with a certain angle from the center position and defines the reverse position (R). Thus, the remote controller shift lever 45 can freely incline in a fore to aft direction (left to right direction of FIG. 5). A potentiometer 46 detects operational information such as an operational speed/angle of the remote controller shift lever 45. The operational information is transmitted to the remote controller side ECU 44.

The remote controller operating section 13 includes an extremely slow speed change switch 50 functioning as the "change operation section" whereby the watercraft operator can select one of the normal navigation and the extremely slow speed navigation (i.e., the watercraft operator can select a main control section (described later) or an auxiliary control section (described later)).

As shown in FIG. 4, signals from the remote controller side ECU 44 are transmitted to the engine side ECU 41 belonging to the outboard motor 11. The engine side ECU 41 who receives the signals controls the shift motor 47 of the shift actuator 22 based upon operational amounts of the remote controller shift lever 45. Thereby, the shift change unit 21 is actuated to change the shift modes among the forward, neutral and reverse modes.

The steering unit 15 includes a steering unit side ECU (not shown) incorporated therein and a steering wheel 48. A position sensor (not shown) detects a position of the steering wheel 48. The position sensor is connected to the steering unit side ECU through signal circuits.

The steering unit side ECU of the steering unit 15 is connected to the engine side ECU 41.

The control micro-computer 42 as shown in FIG. 4 preferably includes at least one CPU (not shown). The CPU executes calculation processes using RAM (not shown) as a working space and using programs and data stored in a storing device 49A such as, for example, ROM and EPROM. The control micro-computer 42 includes the main control section 61 that controls various function, based upon execution results of the programs and hardware logics; an auxiliary control section 62; and a changeover section 63. The main control section 61 controls the operation of the shift actuator 22 in the normal navigation state. The auxiliary control section 62 controls the operation of the shift actuator 22 in the extremely slow speed navigation state. The changeover section 63 selects one control section used for the navigation of the watercraft 10 by changing between the main control section 61 and the auxiliary control section 62.

The storing device 49A stores a selection table 49 forming a portion of the auxiliary control section 64. The selection table 49 includes a first selection table 491, for example, shown in FIG. 6A and a second selection table 492, for example, shown in FIG. 6B. Each selection table 491, 492 has a plurality of extremely slow speed navigation instructing data 49*a*1, 49*a*2, . . . 49*an* (n>1), 49*b*1, 49*b*2, . . . 49*bm* (m>1) which designate shift positions (angles) and data corresponding to shift speeds both defined for contributing to performing a piece of extremely slow speed navigation adapted to a watercraft navigation whereby the watercraft can move back to the "point." The respective extremely slow speed navigation instructing data 49*a*1, 49*a*2 . . . 49*an*, 49*b*1, 49*b*2 . . . 49*bm* are previously determined by experiments or the like so as to be adapted to characteristics of the engine 16 of the outboard motor 11 (for example, an output, weight, etc. of the engine 16), characteristics of the individual watercraft 10 (for example, weight and the number of the outboard motor 11, a shape of the propeller, weight of the hull 12, etc.), and the like. Thereby, the watercraft can make a piece of extremely slow speed navigation adapted to a current condition of the watercraft 10 based upon one of the extremely slow speed navigation instructing data 49*a*1, 49*a*2 . . . 49*an*, 49*b*1, 49*b*2 . . . 49*bm*.

The first selection table 491 exemplified in FIG. 6A is provided for the forward mode and preferably includes nine types of extremely slow speed navigation instructing data 49*a*1, 49*a*2, . . . 49*a*9. Each extremely slow speed navigation instructing data 49*a*1, 49*a*2, . . . 49*a*9 has an angle of the remote controller shift lever 45 (inclination angle relative to the neutral position (N) that makes the reference angle) providing a table line name, and a neutral period and a forward period both giving table contents (i.e., the neutral period and the forward period together form one cycle). For example, when the remote controller shift lever 45 is set at the forward side angle of 10° to select the extremely slow speed navigation instructing data 49*a*2, the neutral period of 25 seconds and the forward period of one second are alternately repeated. When the shift lever 45 is set at the forward side angle of 30° to select the extremely slow speed navigation instructing data 49*a*4, the neutral period of twelve seconds and the forward period of two seconds are alternately repeated. When the shift lever 45 is set at the forward side angle of 60° to select the extremely slow speed navigation instructing data 49*a*7, the neutral period of six seconds and the forward period of five seconds are alternately repeated. Additionally, in the description below, the extremely slow speed navigation instructing data will be indicated by the numeral and symbol "49*a*" unless any distinction is necessary, because all the extremely slow speed navigation instructing data 49*a*1, 49*a*2 . . . 49*a*9 basically has the same formation.

The second selection table 492 exemplified in FIG. 6B is provided for the reverse mode and preferably includes six sorts of extremely slow speed navigation instructing data 49*b*1, 49*b*2, . . . 49*b*6. Each extremely slow speed navigation instructing data 49*b*1, 49*b*2, . . . 49*b*6 has an angle of the remote controller shift lever 45 in the automatic watercraft navigation, the angle giving a table line name, and a neutral period and a forward period both giving table contents (i.e., the neutral period and the forward period together form one cycle). For example, when the remote controller shift lever 45 is set at the reverse side angle of 10° to select the extremely slow speed navigation instructing data 49*b*2, the neutral period of 15 seconds and the reverse period of one second are alternately repeated. When the shift lever 45 is set at the reverse side angle of 30° to select the extremely slow speed navigation instructing data 49*b*4, the neutral period of six seconds and the reverse period of five seconds are alternately repeated. When the shift lever 45 is set at the reverse side angle of 45° to select the extremely slow speed navigation instructing data 49*b*6, the neutral period of zero second and the reverse period of thirty seconds are alternately repeated. Additionally, in the description below, the extremely slow speed navigation instructing data will be indicated by the numeral and symbol "49*b*" unless any distinction is necessary, because all the extremely slow speed navigation instructing data 49*b*1, 49*b*2, . . . 49*b*6 basically has the same formation.

The auxiliary control section 62 is configured to make the shift actuator 22 operate based upon the extremely slow speed navigation instructing data 49*a*, 49*b*. That is, the shift device 18 operates with the extremely slow speed navigation instructing data 49*a*, 49*b* and automatically performs the extremely slow speed navigation that is suitable for the watercraft to move back to the "point." That is, the shift device 18 makes the hand-free watercraft navigation practicable.

Figure 7A:
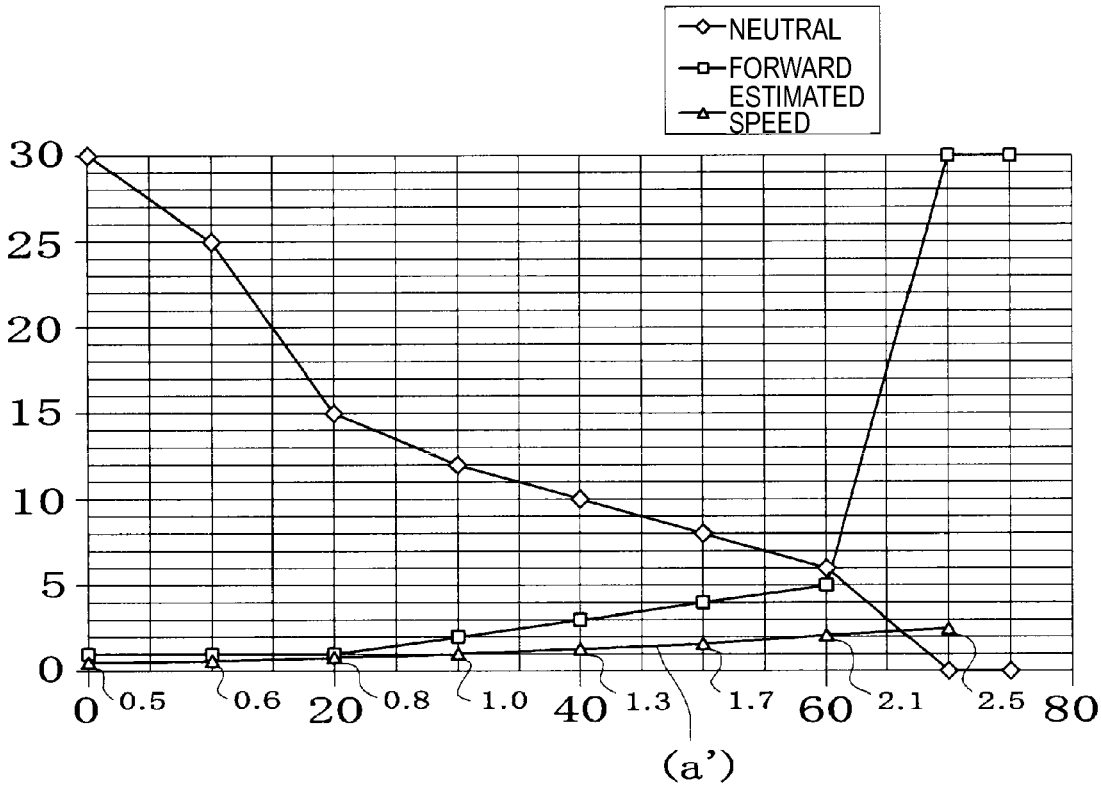
FIGS. 7A and 7B illustrate graphs in which the selection tables are graphed, with FIG. 7A showing a graph of the selection table for the forward mode and FIG. 7B showing a graph of the selection table for the reverse mode.
Figure 7B:
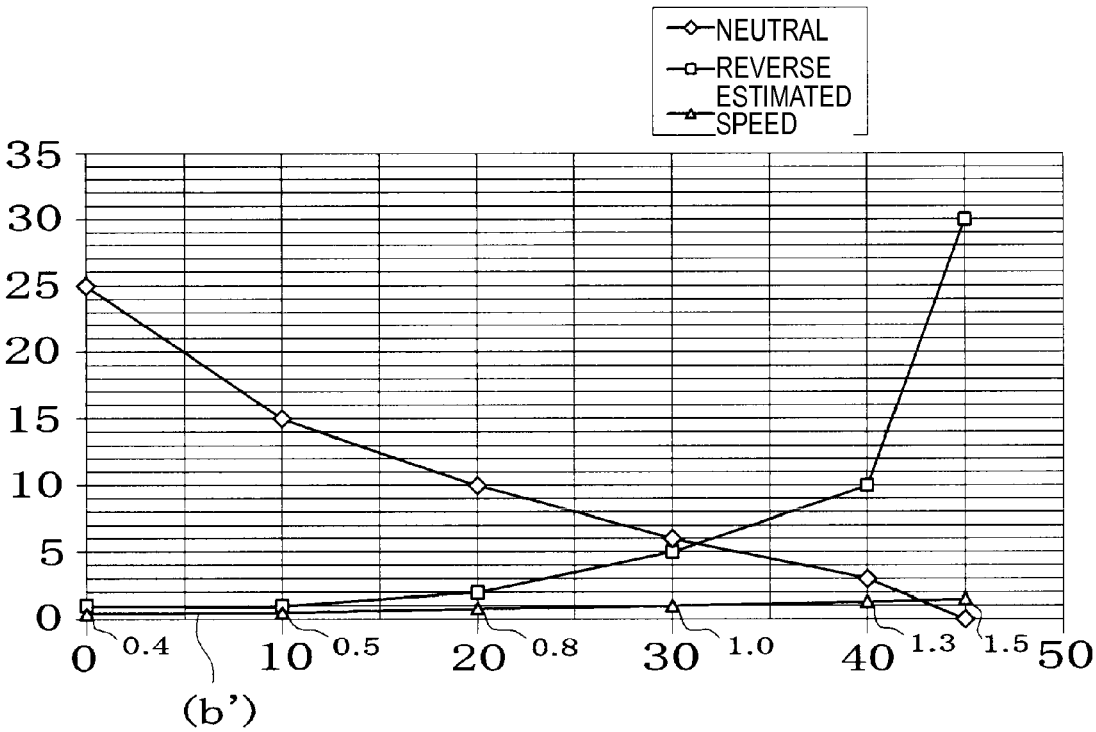

FIG. 7A is a graph indicating estimated speeds obtained based upon relationships between angles of the remote controller shift lever 45 and neutral periods and forward (or reverse) periods in the automatic navigation made using the first selection table 491. FIG. 7B is a graph indicating estimated speeds obtained based upon relationships between angles of the remote controller shift lever 45 and neutral periods and forward periods in the automatic navigation made using the second selection table 492. As shown in those figures, the forward (or reverse) periods and the neutral periods and the estimated speeds are individually indicated on the same vertical axes of the graphs. The forward (or reverse) period and the neutral period on each of the same vertical axes together form one cycle of the extremely slow speed navigation instructing data 49*a*, 49*b*. Each estimated speed indicates an estimated navigation speed of the watercraft obtained from the result that the forward (or reverse) period and the neutral period on each of the same vertical axes are alternately repeated.

In FIGS. 7A and 7B, the forward (or reverse) periods, the neutral periods and the estimated speeds independently form line graphs. As is understood from the inclination tendency of those graphs, as the estimated speed is slower in the extremely slow speed navigation instructing data 49*a* (or 49*b*), the forward (or reverse) period is set to be shorter and the neutral period is set to be longer, and as the estimated speed is faster in the extremely slow speed navigation instructing data 49*a* (or 49*b*), the forward (or reverse) period is set to be longer and the neutral period is set to be shorter. Therefore, the speed can be adjusted while the shift change times are reduced as small as possible.

The estimated speed curve a' of the forward mode indicated in the graph of FIG. 7A and the estimated speed curve b' of the reverse mode indicated in the graph of FIG. 7B both are curves whose right side is always higher than the left side thereof. Accordingly, it is understood from the estimated speed curves a', b' that the watercraft can have a faster speed by enlarging the angle of the remote controller shift lever 45. Thus, by enlarging the angle, for example, the time for returning back to the "point" where fish flock (zero point) can be shortened.

Next, operations made in this preferred embodiment will be described herein after.

Under the condition that the extremely slow speed change switch 50 is not pushed, the changeover section 63 designates the main control section 61 as the control section which controls the shift actuator 22 to operate. Thereby, the remote controller shift lever 45 functions as the shift lever for the normal navigation. That is, when the watercraft operator inclines the remote controller shift lever 45 forward (or backward), the remote controller side ECU 44 sends an operational instruction of the forward (or reverse) normal navigation to the main control section 61 based upon an operational amount (i.e., inclination angle) of the remote controller shift lever 45 from the neutral position (N). The main control section 61 controls the shift actuator 22 to operate based upon the operational instruction. Thereby, the shift change unit 21 changes the shift modes among the forward, neutral and reverse modes. The watercraft 10 thus moves forward (or backward) in the normal navigation state.

On the other hand, when the watercraft operator pushes the extremely slow speed change switch 50, the changeover section 63 changes the control section, which makes the shift actuator 22 operate, from the main control section 61 to the auxiliary control section 62. Thereby, the remote controller shift lever 45 functions as the shift lever for the extremely slow speed navigation. That is, when the watercraft operator inclines the remote controller shift lever 45 forward (or backward), the remote controller side ECU 44 sends an operational instruction of the forward (or reverse) extremely slow speed navigation to the auxiliary control section 62 based upon an operational amount (i.e., inclination angle) of the remote controller shift lever 45 from the neutral position (N). Upon the input of the operational instruction, the auxiliary control section 62 obtains one of the extremely slow speed navigation instructing data 49*a* (or 49*b*) corresponding to the instruction from the first selection table 491 (or the second selection table 492) based upon the angle information of the remote controller shift lever 45 contained in the operational instruction. The auxiliary control section 62 then controls the shift actuator 22 to operate based upon the neutral period and the forward period (or reverse period) contained in the table line of the extremely slow speed navigation instructing data 49*a* (or 49*b*). The shift change unit 21 moves toward the forward side (or reverse side) by the forward period (or the reverse period) of the extremely slow speed navigation instructing data 49*a* (or 49*b*), and then moves toward the neutral side by the neutral period of the extremely slow speed navigation instructing data 49*a* (or 49*b*). Afterwards, similarly, the shift change unit 21 repeats the operations such that the shift change unit 21 moves toward the forward side (or reverse side) during the forward period (or the reverse period) and moves toward the neutral side during the neutral period. Thereby, the watercraft 10 moves forward (or backward) in the extremely slow speed navigation state.

Further, when the watercraft operator changes the angle of the remote controller shift lever 45 under the condition that the extremely slow speed change switch 50 has been pushed, the remote controller side ECU 44 sends a new operational instruction of the extremely slow speed navigation to the auxiliary control section 62 based upon the inclination angle of the remote controller shift lever 45 and the auxiliary control section 62 obtains a new extremely slow speed navigation instructing data 49*a* (or 49*b*). Then, similarly to the extremely slow speed navigation control described above, the shift change unit 21 repeats the operations such that the shift change unit 21 moves toward the forward side (or reverse side) during the forward period (or the reverse period) and moves toward the neutral side during the neutral period.

As thus described, in this preferred embodiment, the changeover section 63 changes the main control section 61 to the auxiliary control section 62. Afterwards, one of various sorts of extremely slow speed navigations which are previously set can be easily and automatically performed by operating the remote controller shift lever 45. Then, the auxiliary control section 62 automatically performs the shift change operations between the forward (or reverse) shift mode and the neutral shift mode in the extremely slow speed navigation state. Thereby, the watercraft operator can be released from the complicated shift change operations in the extremely slow speed navigation state. The automatic navigation thus can provide the watercraft operator with much marginal time. In addition, timing of the shift changes between the forward (or reverse) shift mode and the neutral shift mode in the extremely slow speed navigation state can be automatically determined in accordance with the forward or reverse period and the neutral period which are previously set in the extremely slow speed navigation instructing data 49*a* (or 49*b*). Therefore, variations in the operation skill of each watercraft operator can be negated.

The forward period (or reverse period) and the neutral period preset in the extremely slow speed navigation instructing data 49*a* (or 49*b*) can be set as long as possible individually. The shift operation times (clutch change times) in the extremely slow speed navigation state thus can be reduced. Hence, the situation in which the life of an engine is shortened due to wear of the shift device 18, which may be caused by a watercraft operator who has less experience, can be avoided.

The respective first and second selection tables 491, 492 have the plurality of extremely slow speed navigation instructing data 49*a* (or 49*b*). The shift device 18 can be operated in accordance with one of the extremely slow speed navigation instructing data 49*a* (or 49*b*) selected following the operation of the remote controller shift lever 45 by the watercraft operator to move the watercraft 10 in the extremely slow speed navigation state. Therefore, one of the extremely slow speed navigation instructing data 49*a* (or 49*b*) adapted to tide velocity and wind velocity can be selected so that the watercraft 10 can stay at the "point" as long as possible (i.e., the actual time for fishing can be elongated).

Accordingly, in the watercraft 10 of this preferred embodiment, automatic extremely slow speed navigation and easy navigation of the watercraft can be achieved and differences between navigation skills of watercraft operators can be resolved.

In this preferred embodiment, the remote controller shift lever 45, without any other elements, can achieve both the shift change function in the normal navigation state and the function for selecting one of the extremely slow speed navigation instructing data 49*a* (or 49*b*) in the extremely slow speed navigation state. The construction of the remote controller shift lever 45 thus can be simple and the lever has good operability.

Additionally, in the angle setting operation of the remote controller shift lever 45, i.e., the selecting operation of the extremely slow speed navigation instructing data 49*a* (or 49*b*), the watercraft operator decides the angle by his or her experience and intuition when the bow or the stern of the watercraft is directed toward a target point or while being directed toward the point. Also, if there is sudden change of wind, change of tide or the like under the automatic watercraft navigation condition, the watercraft operator, by interrupting the automatic navigation, properly adjusts the direction of the bow or the stern of the watercraft so that the watercraft can be back on the right way toward the target point.

The respective extremely slow speed navigation instructing data 49*a* (or 49*b*) can have sets of data other than those which are described above. The new sets of data can be determined by experiment, calculation, prospect or other measures. The watercraft operator can arbitrarily make the automatic navigation using one of the various sorts of extremely slow speed navigation instructing data 49*a* (or 49*b*) adapted to conditions of the "point."

Various sorts of selection tables 49 can be prepared so that the watercraft operator can select one or more in those tables.

Some of or all of the neutral period or the forward or reverse period of the extremely slow speed navigation instructing data 49*a* (or 49*b*) contained in the first and second selection tables 491, 492 can be equal to each other. Thereby, a drifting distance or a returning distance of the watercraft can be fixed. Also, the neutral period can be elongated to save fuel consumption.

If combinations of the neutral period or forward or reverse period of the extremely slow speed navigation instructing data 49*a* (or 49*b*) are modified as discussed above, compensation for lack of watercraft operator skill can be easily achieved, and minute navigation adapted to the trolling operation is realized, and so forth. Also, the pattern formation can be used in a large-scale trolling method or the like.

A plurality of selection tables 49 can be prepared corresponding to various sorts of engines. For example, both of a selection table for an outboard motor 11 and a selection table for an inboard engine (internally disposed engine) can be prepared, and one of the tables suitable for the outboard motor engine or the inboard engine can be selected in accordance with the situation in which the outboard motor is mounted to the watercraft or the inboard engine is mounted to the watercraft.

Figure 8:
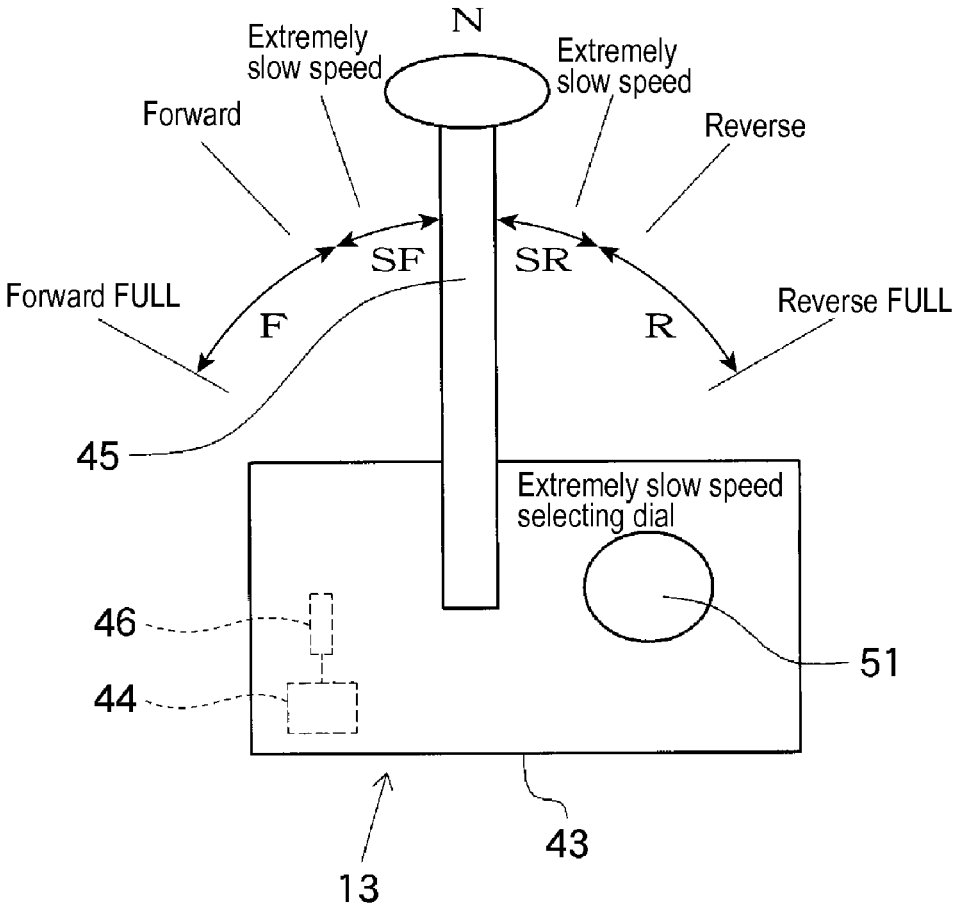
FIG. 8 is a side elevational view of a remote controller operating device of a control device for a watercraft propulsion system according to another preferred embodiment of the present invention.

FIG. 8 shows another preferred embodiment of the present invention, in which, a control device for a watercraft propulsion system is different from the control device of the first preferred embodiment in the following points, as understandable by comparing of FIG. 8 and FIG. 5 with each other. First, the change function of the main/auxiliary control section performed by the extremely slow speed change switch 50 described in the first preferred embodiment is performed by extremely slow speed control ranges provided in the operational range of the remote controller shift lever 45 of the remote controller operating section 13, i.e., the extremely slow speed control ranges function as the "change operation section." Second, the item selection function made on the selection table 49 and performed by the same remote controller shift lever 45 is performed by an extremely slow speed selecting dial 51 attached to the remote controller operating section 13 and functioning as "instructing data selecting section."

As shown in FIG. 8, the operational range of the remote controller shift lever 45 is the same as the range of the shift lever of the first preferred embodiment in the following points. First, the generally vertically extending center position defines the neutral position (N). Second, a position of the lever inclined forward (the left side of the figure) with a certain angle from the center position defines the forward position (F). Third, a position of the lever inclined rearward (the right side of FIG. 8) with a certain angle from the center position defines the reverse position (R). Fourth, the lever 45 can freely incline in a fore to aft direction (left to right direction of FIG. 8). However, the operational range of the remote controller shift lever 45 is different from the range of the shift lever of the first preferred embodiment in the following points.

First, an extremely slow speed forward position (range) (SF) is provided between the neutral position and the forward position (range). Second, an extremely slow speed reverse position (range) (SR) is provided between the neutral position and the reverse position (range).

On the other hand, the extremely slow speed selecting dial 51 is a dial type change switch having change points (not shown) corresponding to the number of extremely slow speed navigation instructing data 49*a* (or 49*b*) contained in the first and second selection table 491, 492. That is, the extremely slow speed selecting dial 51 in this preferred embodiment preferably includes nine change points corresponding to the number of the first selection table 491.

Each extremely slow speed navigation instructing data 49*a* (or 49*b*) is allotted to the respective change point of the extremely slow speed selecting dial 51. More specifically, the change point selected when the dial is rotated to the most left position is allotted to the extremely slow speed navigation instructing data 49*a*1 of the first selection table. Also, operational information of operational speed and angle and the change point at the second position next to the most left position of the table dial is allotted to the extremely slow speed navigation instructing data 49*a*2. Similarly, the same relationships are decided with the other change positions and the extremely slow speed selecting dial 51. Operational information of the rotational angle of the extremely slow speed selecting dial 51 is detected by the potentiometer 46 and is transmitted to the remote controller side ECU 44.

The structures other than those described above are the same as those of the first preferred embodiment.

Next, operations performed in this preferred embodiment will be described below.

When the remote controller shift lever 45 is inclined to the neutral position (N), to the forward position (F) or to the reverse position (R), the changeover section 63 changes the control section that operates the shift actuator 22 to the main control section 61 and the watercraft 10 makes the normal navigation.

When the remote controller shift lever 45 is inclined to the extremely slow speed forward position (SF) (or to the extremely slow speed reverse position (SR)), the changeover section 63 changes the control section that operates the shift actuator 22 and the watercraft 10 makes the extremely slow speed navigation. On this occasion, the remote controller side ECU 44 sends change point information of the extremely slow speed selecting dial 51 to the auxiliary control section 62. The auxiliary control section 62 obtains one of the extremely slow speed navigation instructing data 49*a* (or 49*b*) allotted to the change point and controls the shift change unit 21 based upon the extremely slow speed navigation instructing data 49*a* (or 49*b*).

As thus discussed, in this preferred embodiment, the normal navigation and the extremely slow speed navigation can be changed to one another only by an inclination angle of the one remote controller shift lever. Also, the remote controller shift lever can achieve both the shift change function in the normal navigation state and the function for selecting one of the extremely slow speed navigation instructing data in the extremely slow speed navigation state. The construction of the remote controller shift lever thus can be simple and the lever has good operability, in addition to the effects of the first preferred embodiment.

Also, in this preferred embodiment, the position of the remote controller shift lever 45 at which the extremely slow speed navigation is remotely controlled is placed at the location ranging to the forward position or the reverse position. Hence, the selection of the forward mode in the extremely slow speed navigation state and the selection of the reverse mode in the extremely slow speed navigation state both by the remote controller shift lever can be made easily and rapidly by continuous operations from the forward mode in the normal navigation state and from the reverse mode in the normal navigation state.

In FIG. 8, the forward extremely slow speed control position is located between the neutral position and the forward position, and the reverse extremely slow speed control position is located between the neutral position and the reverse position. Alternatively, even only one of the forward or reverse extremely slow speed control positions can be practicable. Also, the forward and reverse extremely slow speed control positions can be placed at other locations in the operational range of remote controller shift lever 45.

Additionally, in both of preferred embodiments described above, the extremely slow speed change switch 50, the remote controller shift lever 45 and the extremely slow speed selection dial 51 are preferably used as the change operation section and the item selecting section. Alternatively, these sections can have devices incorporating a push button switch, a ten-key switch, a selection switch, etc., replacing the components noted above.

Instead of using the selection tables 49, data maps previously made from experimental data or the like and stored in data storing devices or approximate formulas indicative of the optimum extremely slow speed control characteristics stored in storing devices are usable. Also, the selection tables, data maps and the approximate formulas can be provided under conditions that they are preserved in read-only disk type storing media such as, for example, CD-ROMs.

In the preferred embodiments described above, the outboard motor is preferably used as the "watercraft propulsion system". However, the "watercraft propulsion system" is not limited to the outboard motor and of course can be an inboard-outboard device, inboard or the like.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A control device for a watercraft propulsion system comprising:

a remote controller operating section including a remote controller shift lever arranged to remotely control forward, neutral and reverse modes, a watercraft propulsion section including a shift change unit arranged to make shift changes among the forward, neutral and reverse modes and a shift actuator arranged to drive the shift change unit, and a main control section arranged to control an operation of the shift actuator based upon an operational amount of the remote controller shift lever when the remote controller shift lever is operated;

an auxiliary control section arranged to control a watercraft to move at an extremely slow speed by alternately changing the shift actuator between the forward or reverse shift mode and the neutral mode; and a change operation section arranged to select one of the auxiliary control section and the main control section; wherein the auxiliary control section includes a selection table including a plurality of extremely slow speed navigation instructing data generated by combining a predetermined forward or reverse period and a predetermined neutral period, the selection table being adapted to move a watercraft hull at the extremely slow speed when the change operation section is changed to an extremely slow speed control state;

the remote controller operating section includes an instructing data selecting section arranged to output an execution instruction of the extremely slow speed navigation to the shift actuator by selecting one of the plurality of extremely slow speed navigation instructing data; and the remote controller shift lever functions as the instructing data selecting section when the auxiliary control section is selected by the change operation section, and the one of the plurality of extremely slow speed navigation instructing data is selected based upon the operational amount of the remote controller shift lever.

2. The control device for a watercraft propulsion system according to claim 1, wherein an extremely slow speed control position functioning as the change operation section is located in an operation range of the remote controller shift lever, and the instructing data selecting section is capable of selecting the one of the plurality of extremely slow speed navigation instructing data.

3. The control device for a watercraft propulsion system according to claim 2, wherein the extremely slow speed control position is located at least in a range between a neutral position and a forward position or in a range between the neutral position and a reverse position.

4. The control device for a watercraft propulsion system according to claim 1, wherein as a speed that is slower in the extremely slow speed navigation instructing data, the forward or reverse period is set to be shorter and the neutral period is set to be longer, and as the speed that is faster in the extremely slow speed navigation instructing data, the forward or reverse period is set to be longer and the neutral period is set to be shorter.

5. The control device for a watercraft propulsion system according to claim 1, wherein an individual one of the extremely slow speed navigation instructing data included in the selection table is adapted to a characteristic of an engine of a particular watercraft propulsion section and a characteristic of a particular watercraft.

* * * * *